US010530106B2

(12) United States Patent
Baum et al.

(10) Patent No.: US 10,530,106 B2
(45) Date of Patent: Jan. 7, 2020

(54) MODULAR PLUG CONNECTOR WITH MULTILAYER PCB FOR VERY HIGH SPEED APPLICATIONS

(71) Applicant: Bel Fuse (Macao Commercial Offshore) Limited, Andar H-J (MO)

(72) Inventors: Andrew David Baum, York, PA (US); Richard D. Marowsky, York, PA (US); David Henry Gutter, Felton, PA (US); Yakov Belopolsky, Harrisburg, PA (US); Jennifer L. Allison, Seven Valleys, PA (US); Mark Ellis, York, PA (US)

(73) Assignee: Bel Fuse (Macao Commercial Offshore) Limited, Macau ( * ) Notice: Subject to any disclaimer, the term of this patent is extended or adjusted under 35 U.S.C. 154(b) by 0 days.

(21) Appl. No.: 16/262,696

(22) Filed: Jan. 30, 2019

(65) Prior Publication Data

US 2019/0237920 A1 Aug. 1, 2019

Related U.S. Application Data

(60) Provisional application No. 62/624,479, filed on Jan. 31, 2018.

(51) Int. Cl.
*H01R 24/64* (2011.01)
*H01R 13/6469* (2011.01)
(Continued)

(52) U.S. Cl.
CPC ..... *H01R 24/64* (2013.01); *H01R 13/506* (2013.01); *H01R 13/514* (2013.01);
(Continued)

(58) Field of Classification Search
CPC .... H01R 24/64; H01R 13/506; H01R 13/514; H01R 13/6466; H01R 13/6469; H01R 13/6585; H01R 13/6587
(Continued)

(56) References Cited

U.S. PATENT DOCUMENTS 6,231,397 B1 5/2001 de la Borbolla et al.
6,305,950 B1 * 10/2001 Doorhy ..... H01R 24/64 439/76.1
(Continued)

FOREIGN PATENT DOCUMENTS

EP 0971459 A2 1/2000
EP 1246318 A2 10/2002
(Continued)

OTHER PUBLICATIONS

International Search Report and Written Opinion for International Application PCT/US2018/025858, dated Jun. 22, 2018, 13 pages.
(Continued)

*Primary Examiner* — Tulsidas C Patel
*Assistant Examiner* — Peter G Leigh
(74) *Attorney, Agent, or Firm* — Patterson Intellectual Property Law, P.C.; Gary L. Montle

(57) ABSTRACT

A modular RJ45-type plug apparatus is provided for forming a connector interface with a connector jack in a high speed data transmission network. A housing comprises an insulative front portion and a conductive shield portion attachable to define an interior, within which is positioned a contact subassembly including a first PCB having cable mounting pads on one end and through holes for elongate plug contacts on the other end. The contacts are connected on one end to the first PCB and on a second end to a second PCB, with bridge portions therebetween collectively defining a jack contact interface. The second PCB comprises desired elec-
(Continued)

trical characteristics which provide the apparatus with certain capacitance compensation properties, wherein the capacitance compensation is offset from a signal path defined between the jack-plug connector interface and the cable pairs.

18 Claims, 17 Drawing Sheets

(51) Int. Cl.

| | |
|---|---|
| ***H01R 13/506*** | (2006.01) |
| ***H01R 13/6587*** | (2011.01) |
| ***H01R 13/514*** | (2006.01) |
| ***H01R 13/6466*** | (2011.01) |
| ***H01R 13/66*** | (2006.01) |
| ***H01R 13/6585*** | (2011.01) |
| *H01R 107/00* | (2006.01) |
| *H01R 13/627* | (2006.01) |
| *H01R 13/6599* | (2011.01) |

(52) U.S. Cl.
CPC ..... *H01R 13/6466* (2013.01); *H01R 13/6469* (2013.01); *H01R 13/6585* (2013.01); *H01R 13/6587* (2013.01); *H01R 13/6658* (2013.01); *H01R 13/627* (2013.01); *H01R 13/6599* (2013.01); *H01R 2107/00* (2013.01); *H01R 2201/04* (2013.01)

(58) Field of Classification Search
USPC ..... 439/941, 620.21
See application file for complete search history.

(56) References Cited

U.S. PATENT DOCUMENTS

| | | | | |
|---|---|---|---|---|
| 6,447,326 | B1 * | 9/2002 | Teach | H01R 13/6658 439/460 |
| 6,464,541 | B1 | 10/2002 | Hashim et al. | |
| 6,877,222 | B2 | 4/2005 | Patel | |
| 7,153,163 | B2 | 12/2006 | Lewis et al. | |
| 7,153,168 | B2 | 12/2006 | Caveney et al. | |
| 7,229,309 | B2 * | 6/2007 | Carroll | H01R 13/6463 439/418 |
| 7,281,957 | B2 | 10/2007 | Caveney | |
| 7,429,195 | B2 | 9/2008 | Buckmeier et al. | |
| 7,481,678 | B2 | 1/2009 | Aekins | |
| 7,658,651 | B2 | 2/2010 | Pepe et al. | |
| 7,686,650 | B2 | 3/2010 | Belopolsky et al. | |
| 7,736,195 | B1 | 6/2010 | Poulsen et al. | |
| 7,785,154 | B2 | 8/2010 | Peng | |
| 7,794,286 | B2 | 9/2010 | AbuGhazaleh et al. | |
| 7,815,462 | B2 * | 10/2010 | Boeck | H01R 4/2433 439/409 |
| 7,857,635 | B2 * | 12/2010 | Goodrich | H01R 4/2412 439/344 |
| 7,924,130 | B2 | 4/2011 | Buckmeier et al. | |
| 7,967,644 | B2 | 6/2011 | Pepe et al. | |
| 7,985,100 | B2 | 7/2011 | Jaouen et al. | |
| 8,033,863 | B2 | 10/2011 | Gutter et al. | |
| 8,077,004 | B2 | 12/2011 | Buckmeier et al. | |
| 8,395,329 | B2 | 3/2013 | Jutras et al. | |
| 8,405,481 | B2 | 3/2013 | Renteria | |
| 8,435,082 | B2 | 5/2013 | Bopp et al. | |
| 8,496,501 | B2 | 7/2013 | Pepe et al. | |
| 8,632,368 | B2 | 1/2014 | Pepe et al. | |
| 8,696,386 | B2 * | 4/2014 | Larsen | H01R 13/5833 439/620.21 |
| 8,795,003 | B2 | 8/2014 | Mattson | |
| 8,894,447 | B2 * | 11/2014 | Canning | H01R 24/28 439/676 |
| 8,936,494 | B2 | 1/2015 | Weinmann et al. | |
| 9,054,460 | B2 * | 6/2015 | Schumacher | H01R 13/658 |
| 9,124,101 | B2 | 9/2015 | Jutras et al. | |
| 9,368,913 | B2 * | 6/2016 | Saito | H01R 13/506 |
| 9,407,044 | B2 | 8/2016 | Caveney et al. | |
| 9,509,107 | B2 * | 11/2016 | Schumacher | H01R 24/64 |
| 9,601,886 | B1 * | 3/2017 | Fransen | H01R 24/64 |
| 9,720,181 | B2 * | 8/2017 | Little | G02B 6/3817 |
| 9,819,131 | B2 * | 11/2017 | Schumacher | H01R 24/64 |
| 2001/0000590 | A1 | 5/2001 | Valadez et al. | |
| 2001/0016455 | A1 | 8/2001 | Reichle | |
| 2003/0134529 | A1 | 7/2003 | Murr et al. | |
| 2003/0194908 | A1 | 10/2003 | Brown et al. | |
| 2004/0023563 | A1 | 2/2004 | Ciezak et al. | |
| 2007/0040645 | A1 | 2/2007 | Sedio et al. | |
| 2007/0212946 | A1 | 9/2007 | Bert et al. | |
| 2007/0217173 | A1 | 9/2007 | Mizutani et al. | |
| 2008/0045090 | A1 | 2/2008 | Caveney | |
| 2009/0142968 | A1 | 6/2009 | Goodrich et al. | |
| 2009/0265918 | A1 | 10/2009 | Dounaevsky | |
| 2010/0041278 | A1 | 2/2010 | Bopp et al. | |
| 2010/0048040 | A1 | 2/2010 | Straka et al. | |
| 2010/0223786 | A1 | 9/2010 | Caveney et al. | |
| 2012/0076459 | A1 | 3/2012 | Sell | |
| 2012/0100744 | A1 | 4/2012 | Bolouri-Saransar et al. | |
| 2012/0122353 | A1 | 5/2012 | Nesme et al. | |
| 2012/0188865 | A1 | 7/2012 | Michaelis et al. | |
| 2013/0210288 | A1 | 8/2013 | Schumacher et al. | |
| 2013/0210289 | A1 * | 8/2013 | Schumacher | H01R 12/53 439/676 |
| 2013/0225009 | A1 * | 8/2013 | Hashim | H01R 13/6466 439/676 |
| 2014/0011403 | A1 | 1/2014 | Siev et al. | |
| 2014/0073196 | A1 | 3/2014 | Hashim et al. | |
| 2014/0203886 | A1 | 7/2014 | Schumacher | |
| 2014/0227911 | A1 | 8/2014 | Lim et al. | |
| 2014/0256191 | A1 | 9/2014 | Caveney et al. | |
| 2014/0273629 | A1 | 9/2014 | Canning et al. | |
| 2014/0273657 | A1 | 9/2014 | Hashim et al. | |
| 2015/0207283 | A1 | 7/2015 | Guitard et al. | |
| 2016/0020567 | A1 | 1/2016 | Belopolsky et al. | |
| 2016/0093431 | A1 | 3/2016 | Quilici | |
| 2016/0172079 | A1 | 6/2016 | Rohrer | |
| 2016/0187951 | A1 | 6/2016 | Buckmeier et al. | |
| 2017/0222375 | A1 * | 8/2017 | Cui | H01G 4/38 |
| 2017/0317450 | A1 * | 11/2017 | Valenti | H01R 24/64 |
| 2018/0040987 | A1 * | 2/2018 | Marowsky | H01R 13/6463 |

FOREIGN PATENT DOCUMENTS

| | | | |
|---|---|---|---|
| EP | 2765656 | A1 | 8/2014 |
| GB | 2343558 | A | 5/2000 |
| WO | 2005101588 | A1 | 10/2005 |
| WO | 2006081423 | A1 | 8/2006 |
| WO | 2010065588 | A1 | 6/2010 |
| WO | 2016187385 | A1 | 11/2016 |
| WO | 2017015459 | A1 | 1/2017 |

OTHER PUBLICATIONS

International Search Report and Written Opinion for International Application PCT/US2016/043334, dated Aug. 4, 2017, 9 pages.

International Search Report for International Application PCT/US2016/060963, dated Feb. 17, 2017, 13 pages.

The International Search Report and Written Opinion of corresponding International Application No. PCT/US2019/016042 dated Apr. 12, 2019, 13 pages.

"CONEC RJ45 Connector System Mouser" Anonymous article dated Dec. 3, 2016, retrieved from the internet: URL:https//web.archive.org/web/20161203134440/http://nl.mouser.com/new/conec/conec-rj45-ip67/ [retrieved on Apr. 5, 2019].

* cited by examiner

MODULAR PLUG CONNECTOR WITH MULTILAYER PCB FOR VERY HIGH SPEED APPLICATIONS

CROSS-REFERENCES TO RELATED APPLICATIONS

This application claims priority of U.S. Provisioned Patent Application No. 62/624,479, filed Jan. 31, 2018, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF INVENTION

The present disclosure relates generally to modular plugs for data transmission. More particularly, embodiments of a modular plug design are disclosed herein for very high-speed data transmission applications in support of 10, 25 and 40 Gigabit Ethernet protocols, sometimes referred as MULTI-G-BASE-T protocols.

BACKGROUND

The use of modular plugs and jacks for data transmission is common. Plugs are attached to ends of an electrical cable connecting two electronic devices such as switches or routers in data centers or computers in offices. The cables have multiple conductors, or wires. For Ethernet protocol connectivity, typically eight wires are used. While the cable is terminated by plugs, the electronic equipment must have jacks corresponding to the plugs. Plugs and jacks are designed to be intermateable to provide both mechanical and electrical coupling. Mechanical dimensions of the plugs and jacks, and their interface therebetween, are governed by international standards. In the case of the connectors employed in the Ethernet signal transmission the governing standards are International Electrotechnical Commission standards 60603-7 series.

From the transmission point of the jacks, cable and plug represent components of a channel. The channels and corresponding components performance are referred as classes and categories specified in the IEC/ISO 11801 standards shown in the following table:

| ISO/IEC 11801 | Cable/connector category | Freq. max. Characterization |
|---|---|---|
| Class C | 3 | 16 MHz |
| Class D | 5e | 100 MHz |
| Class E | 6 | 250 MHz |
| Class $E_A$ | $6_A$ | 500 MHz |
| Class F | 7 | 600 MHz |
| Class $F_A$ | $7_A$ | 1000 MHz |
| Class I | 8.1 | 2000 MHz |

Common mechanical connector configurations allow the utilization of the existing networking equipment through a feature called auto-negotiation. During the auto-negotiation process, both connected devices assume master-slave relations and agree on the maximum speed for data to be transmitted.

The channels must be able to support the Ethernet protocols and may affect the auto-negotiation. If any component is designed for the older Ethernet speeds, it will force the newer and faster networking equipment to run below its intended speed.

In order to support the 40 Gigabit per second Ethernet protocol, the Class I channel with category 8.1 connectors are required.

The modular plugs connected to the cables can be plugged into jacks disposed within the various generations of the Ethernet equipment. In such cases, the modular plugs are configured to work with equipment of relatively slow speed (i.e. 100 MHz) and also at the other extreme with the highest speed equipment (i.e. 2000 MHz).

A conventional objective of plug design is to assure safe electrical isolation. For example, the equipments should withstand 1000 VDC between adjacent contacts and 1500 VDC between all the contacts and shields without shorting flash-over.

In current practice, the common RJ45 mechanical interface described in the IEC6003-7-1 standard allows connections between 40 GbE and lower speed equipment. However, there are no known modular plugs that work in the wide spectra from 100 to 2000 MHz without causing some degradation of the signals. Plugs mated with corresponding jacks form a mated connector pair, within which the electromagnetic signals travel from the equipment side to the cable side and vice versa.

Ethernet protocols divide the electromagnetic signals into four streams. These streams are transmitted over the same cable. Thus, with a mated connector pair, there are four streams or channels of signals operating simultaneously. The unwanted interaction of these signals is called near end cross talk (or NEXT). The NEXT must be minimized to allow substantially error-free transmission of data. The most common method of reducing NEXT is through compensation. Compensation can be provided by creating signals of similar amplitude but opposite polarity from the NEXT signals that are inherently present at the interface between the jack and the plug. Thus, the compensation NEXT will cancel out the original NEXT.

Signal degradation at high frequencies is caused by one or more of several potentially mutually dependent issues. Introducing compensation far away from the interface may cause an unpredictable phase shift of electromagnetic signals traveling within the jack and plug connection. The plug contact blades have high intrinsic self-inductance and uncontrolled and relatively low capacitance between adjacent contacts. Known designs also do not allow for control of the interaction of the cable pairs within the plug. The distance between the cable terminations and the contacts is overly long in existing designs. Finally, most of the existing plug designs attempt to provide easy termination in the field at the expense of transmission performance.

It would accordingly be desirable to provide a mating interface to a modular jack in accordance with existing mechanical and category 8.1 electrical standards and operate at a wide range of frequency spectra from 100 MHz to 2000 MHz and above.

It would further be desirable to reduce the phase shift between the primary compensation and contact interface.

It would further be desirable to mate such an apparatus with lower category connectors with corresponding degradation of their properties.

It would further be desirable to terminate the apparatus to cables in the field using hand tools, or alternatively to cables at the factory locations, in either event using essentially the same components.

It would further be desirable to provide the apparatus with a configuration that can be easily manufactured and at low cost, for example minimizing the number of plug parts and internal components needs. It would particularly be desirable to require no additional discrete electronic components such as capacitors, inductors and/or resistors.

It would further be desirable to control cable pairs within the plug and further provide isolation of said pairs by an air gap that is integral to the primary printed circuit board.

It would further be desirable if the primary printed circuit board controlled the connector electrical signal properties by means of controlled impedance.

It would further be desirable if the compensation is provided by an independent, secondary rigid printed circuit board.

It would further be desirable if the electrical signal properties are controlled by the intrinsic characteristics of the primary and secondary printed circuit boards, particularly without relying on secondary tuning of these boards.

It would further be desirable for the cable contacts to have low self-inductance and high capacitive coupling.

It would further be desirable to terminate cables within a wide range of wire gages; both stranded and solid conductors from AWG 22 to AWG 28.

BRIEF SUMMARY in various embodiments of a modular connector plug as disclosed herein, the design corresponds relevant mechanical details, size and shape to the industry standard RJ45 plug, and further enables operation within a wide spectra, such as for example from 10 to 2000 MHz, with minimized phase shift and corresponding signal degradation.

Another exemplary aspect of the apparatus is that the components that are used for a field-terminable and factory-terminable plugs are essentially the same.

In a particular embodiment as disclosed herein, a modular connector plug apparatus is provided for forming a connector interface with a connector jack in a high speed data transmission network. The apparatus includes a housing comprising an insulative front portion and a conductive shield portion attachable to define an interior. A contact subassembly is configured for positioning within the interior of said housing and comprises a first printed circuit board (PCB), a plurality of elongate plug contacts, and a second PCB. The first PCB has first end and a second end, the second end comprising conductive mounting pads for each of a plurality of cable pairs. The contacts each comprise a first end mounted on the first end of the first PCB, a second end distal from the first end, and a bridge portion there between, the bridge portions of the plurality of plug contacts collectively defining an interface for corresponding contacts of a connector jack. The respective second ends of the plurality of plug contacts are mounted on the second PCB, wherein the second PCB comprises desired electrical characteristics which provide the apparatus with certain capacitance compensation properties, and wherein the capacitance compensation is offset from a signal path defined between the jack plug connector interface and the cable pairs.

In one desirable aspect of the aforementioned embodiment, the primary compensation is provided in the immediate vicinity of the connector interface. Another exemplary aspect of the apparatus is that the plug contact blades may be very short and have very low intrinsic self-inductance and high capacitance between adjacent contacts.

Another exemplary aspect of the aforementioned apparatus is that the plug uses two separate PCBs rather a single combined PCB. This may generally simplify the manufacturability and result in better control of electrical properties on both PCBs, further eliminating any chances of unwanted electrical interactions.

In one variant of the aforementioned exemplary embodiment of the apparatus, the first PCB further comprises through holes for receiving the respective first ends of the plug contacts, and an air gap slotted from the second end and extending in parallel with electrical aces between the through-holes and the mounting pads. A desirable aspect of such an embodiment of the apparatus is that the position of the cable pairs, and thus the mutual electrical interactions, are tightly controlled by the design of the conductor trace pattern on the primary printed circuit board.

In another variant of the exemplary embodiment of the apparatus, a substantially planar conductive shield is located within the slotted air gap and commoned to one or more ground planes within the first PCB, in an orthogonal orientation with respect to a surface plane of the first PCB.

In another variant of the exemplary embodiment of the apparatus, first and second pairs of conductive mounting pads are provided on a first surface of the first PCB, respectively positioned on opposing first and second sides of the planar conductive shield, and third and fourth pairs of conductive mounting pads are provided on an opposing second surface of the first PCB, respectively positioned on the opposing first and second sides of the planar conductive shield.

In another variant of the exemplary embodiment of the apparatus, the second PCB comprises a plurality of substrate layers having parallel plates disposed therein, and a value of the capacitance compensation is defined by an area, distance and dielectric constant associated therewith.

In another variant of the exemplary embodiment of the apparatus, the contact subassembly comprises a contact retainer configured to receive the plurality of contacts and composed of an isolative material having characteristic dielectric properties providing a supplemental capacitance compensation between adjacent contact pairs and offset from the signal path.

In another variant of the exemplary embodiment of the apparatus, the contact retainer comprises first and second opposing side portions with protrusions extending therefrom, and the front portion of the housing comprises corresponding first and second interior slots configured to slidably receive the first and second opposing side portions via the protrusions.

In another variant of the exemplary embodiment of the apparatus, the first and second interior slots comprise notches along their respective lengths, and the protrusions are configured to compress during insertion into the front portion of the housing and then extend outward to engage the notches.

In another variant of the exemplary embodiment of the apparatus, the front portion of the housing comprises a top side having one or more apertures, and the conductive shield portion of the housing comprises a respective one or more latches configured to engage the one or more apertures when the front portion and the conductive shield portion are slidably engaged.

In another variant of the exemplary embodiment of the apparatus, the conductive shield portion comprises jack grounding tabs extending along first and second opposing outer side walls of the front portion of the housing when the front portion and the conductive shield portion are slidably engaged.

In another variant of the exemplary embodiment of the apparatus, the first and second jack grounding tabs further respectively comprise shield retention tabs configured to fold over the notches of the first and second interior slots when the front portion and the conductive shield portion are slidably engaged, further to engage the protrusions of the contact retainer as extended outward and retained therein.

In another variant of the exemplary embodiment of the apparatus, the bridge portion for each plug contact has a maximum width extending in a direction perpendicular to a PCB length, at least one plug contact having a maximum width greater than the maximum width of another plug contact. Each plug contact defines an electrode of a further compensating capacitance formed between adjacent pairs of plug contacts, each further compensating capacitance defined at least partially by a distance between the respective adjacent pair of plug contacts at the contact interface.

In another variant of the exemplary embodiment of the apparatus, the respective bridge portion for each plug contact has a length extending between the first end and the second end, at least one plug contact having a bridge portion length shorter than the bridge portion length of another plug contact.

In another variant of the exemplary embodiment of the apparatus, the respective first ends for a first plurality of plug contacts and a second plurality of plug contacts are situated in first and second parallel spaced planes.

In various embodiments of the apparatus as disclosed herein, the contact subassembly is configured to withstand 1000 VDC between any two adjacent contacts, and 1500 VDC between any two non-adjacent contacts and/or between any one contact and the conductive shield, without shorting or flash-over.

DETAILED DESCRIPTION

Figure 1:
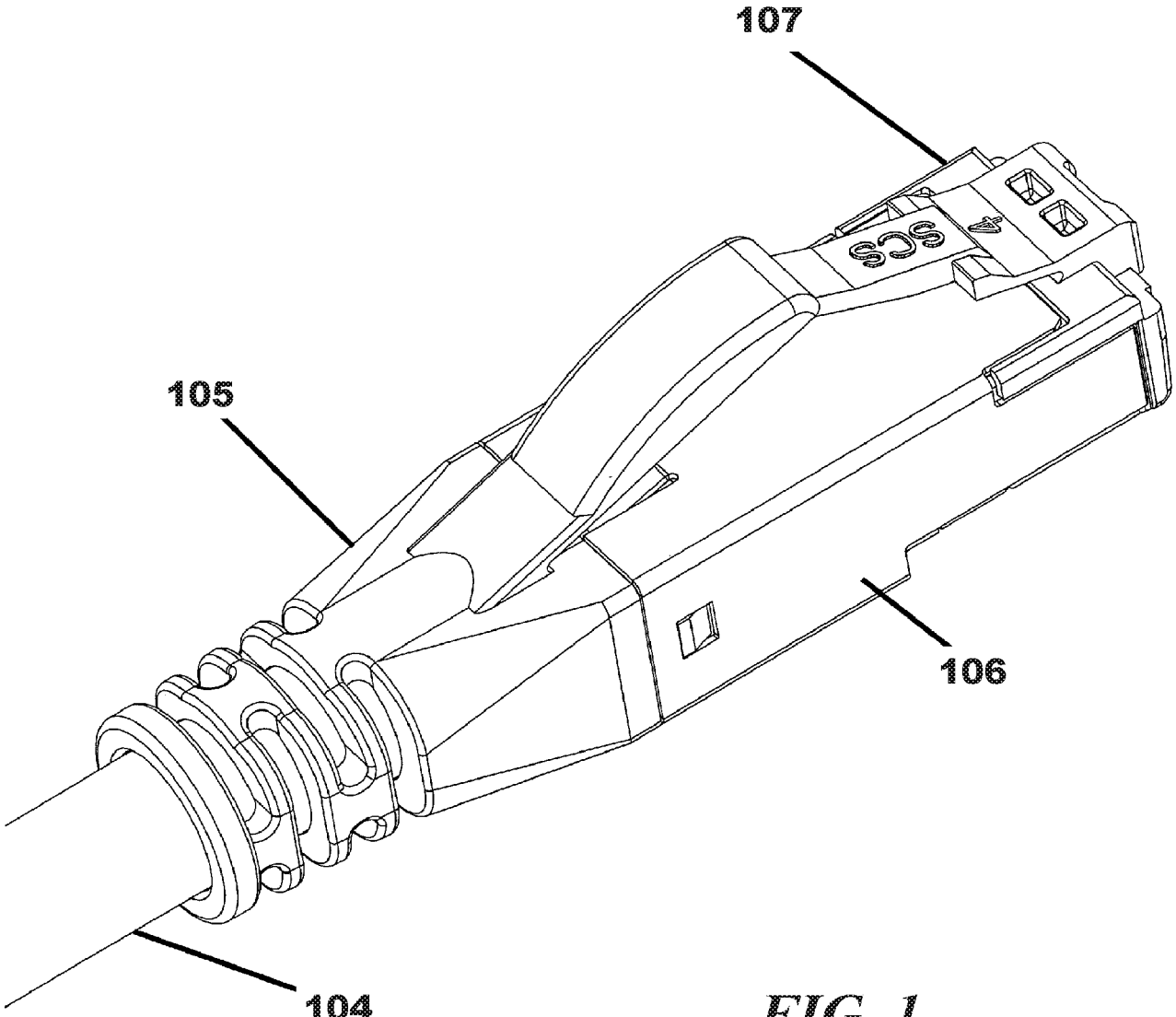
FIG. 1 is a perspective view representing a first embodiment of a modular connector plug as disclosed herein for high speed data transmission.

Referring generally to FIGS. 1-17, various exemplary embodiments of a modular connector plug may now be described in detail. Where the various figures may describe embodiments sharing various common elements and features with other embodiments, similar elements and features are given the same reference numerals and redundant description thereof may be omitted below.

Figure 2:
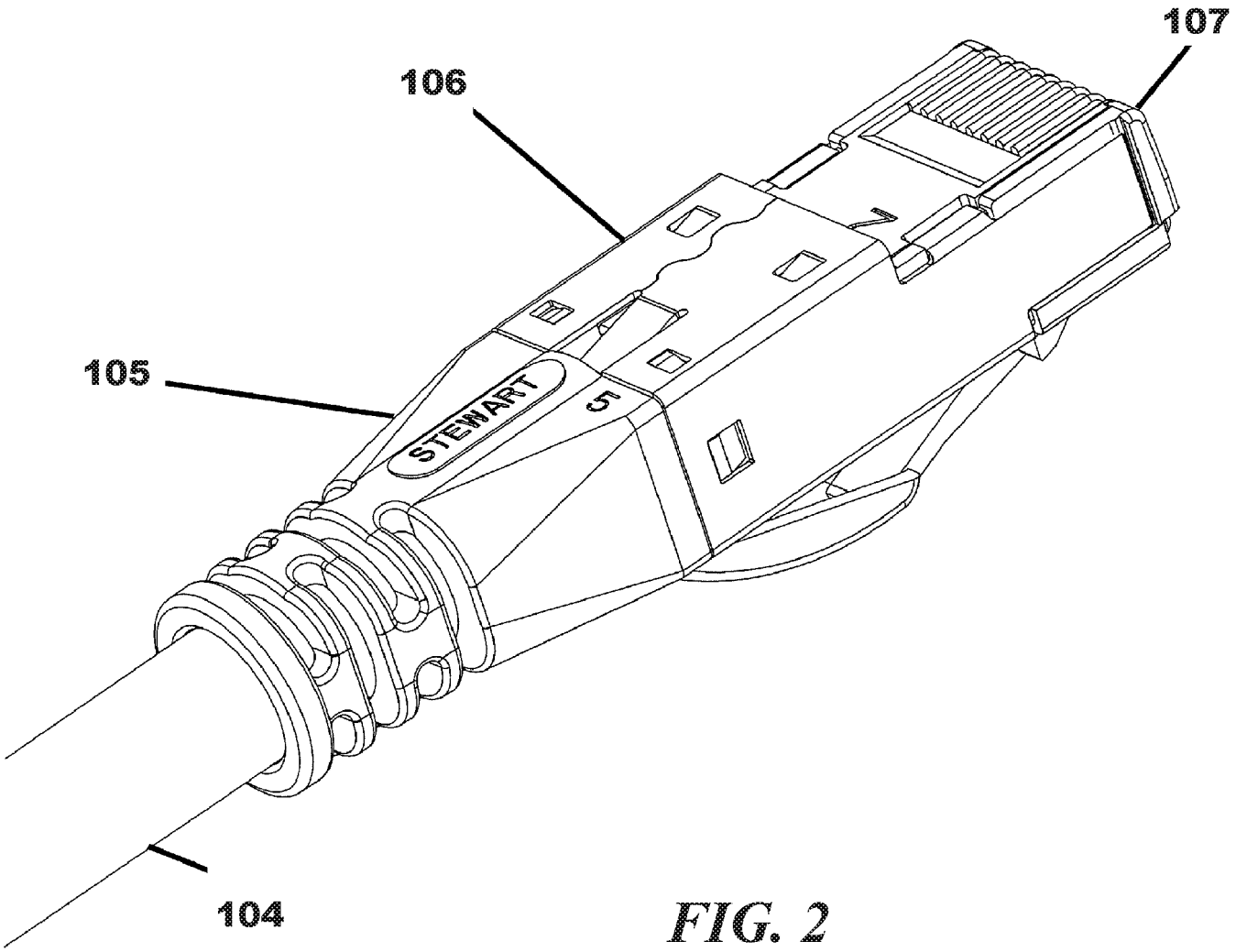
FIG. 2 is an inverted perspective view of the embodiment illustrated in FIG. 1.
Figure 3:
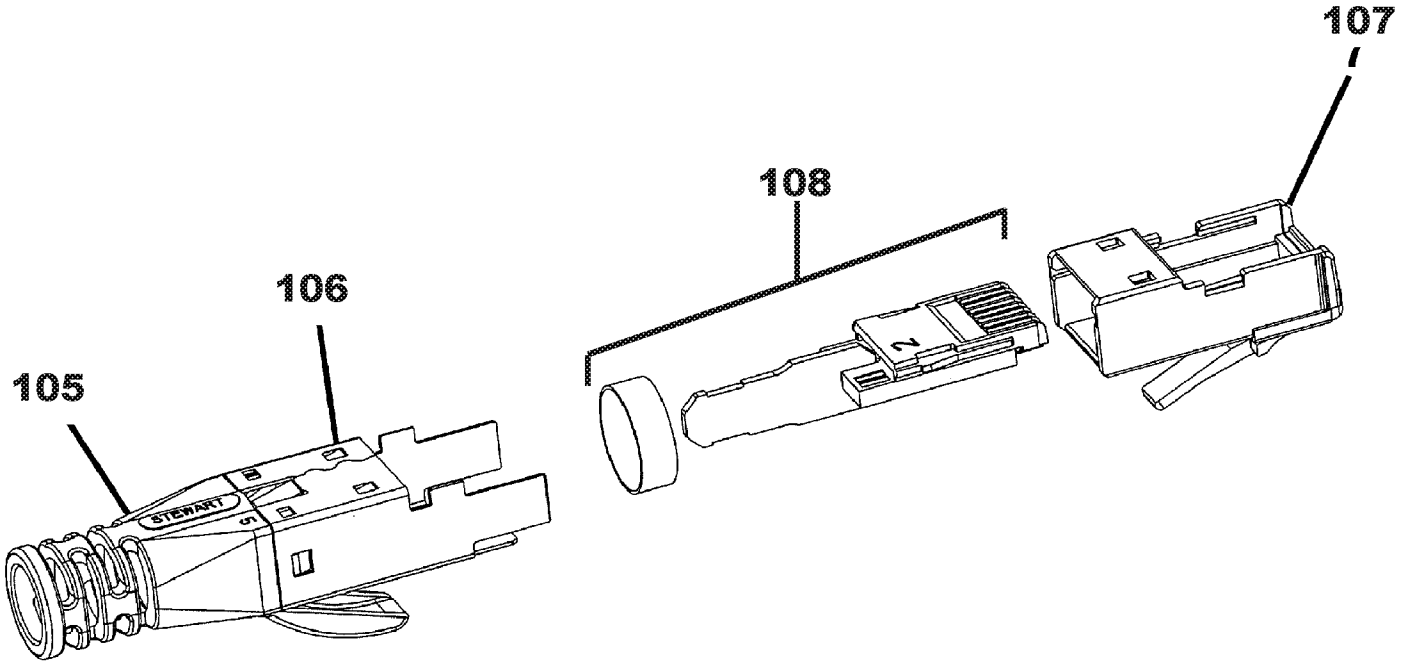
FIG. 3 is an exploded perspective view of the embodiment illustrated in FIG. 1.

An initial embodiment of a modular connector plug as represented in FIGS. 1 and 2 may be configured to form a connector interface with a corresponding female connector jack (not shown) including a plurality of female jack contacts in a high speed data transmission network. A housing is formed of an insulating (e.g., plastic) plug body 107 in operative attachment with a conductive (e.g., metal) shield 106 and an insulating (e.g., plastic) strain relieving body 105. The plug is applied to shielded twisted pair cable 104. Within the plug body is a plug sub-assembly 108. When the plug is to be terminated in the field, it may be supplied in an unassembled configuration (see, e.g., as represented in FIG. 3).

Figure 4:
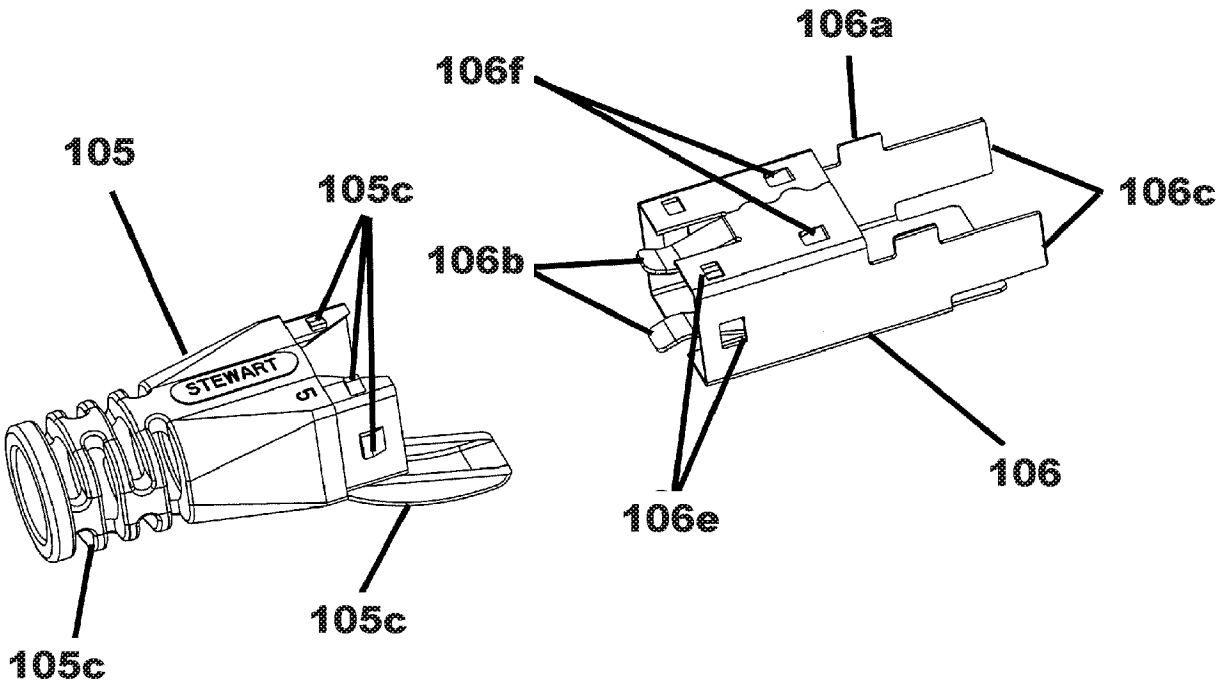
FIG. 4 is a first further exploded perspective view of the embodiment illustrated in FIG. 1.

FIG. 4 shows the strain relief 105 and the outer shield 106 in greater detail. Integral to the strain relief 105 are a cable flexing portion 105*a*, a tab anti-snag portion 105*b* and a plurality of latch features 105*c* that engage with shield apertures (e.g., cut-outs) 106*e* thus locating and retaining the outer shield 106.

The outer shield 106 may also be constructed with additional integral features. In an exemplary embodiment, shield retention tabs 106*a* are formed over once the shield 106 and strain relief 105 are assembled to the plug sub assembly 108 and plug body 107. These retention tabs 106*a* assist in holding the plug together. The electrical ground path of the plug connector is maintained by the cable ground springs 106*b* and the jack ground tabs 106*c*. The cable ground springs 106*b* are formed inward from the main shield 106 and make contact with the foil shields 170*a* of the twisted pairs 170. The ground path continues through the shield 106 and then continues through the plug ground tabs 106*c*. These plug ground tabs 106*c* are disposed on either side of the plug body 107 and make contact with ground springs that are present in typical jack connectors. Plug housing latches 106*f* engage with cut-outs 107*d* in the front housing 107.

Figure 5:
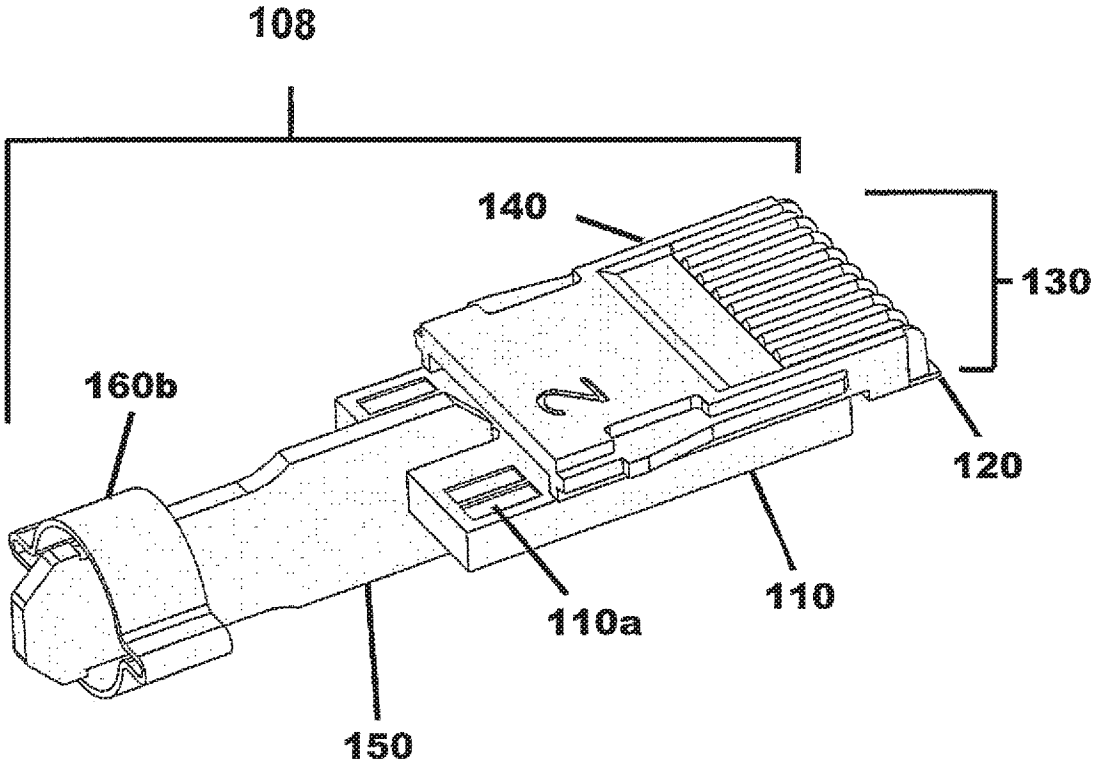
FIG. 5 is a second further exploded perspective view of the embodiment illustrated in FIG. 1.
Figure 6:
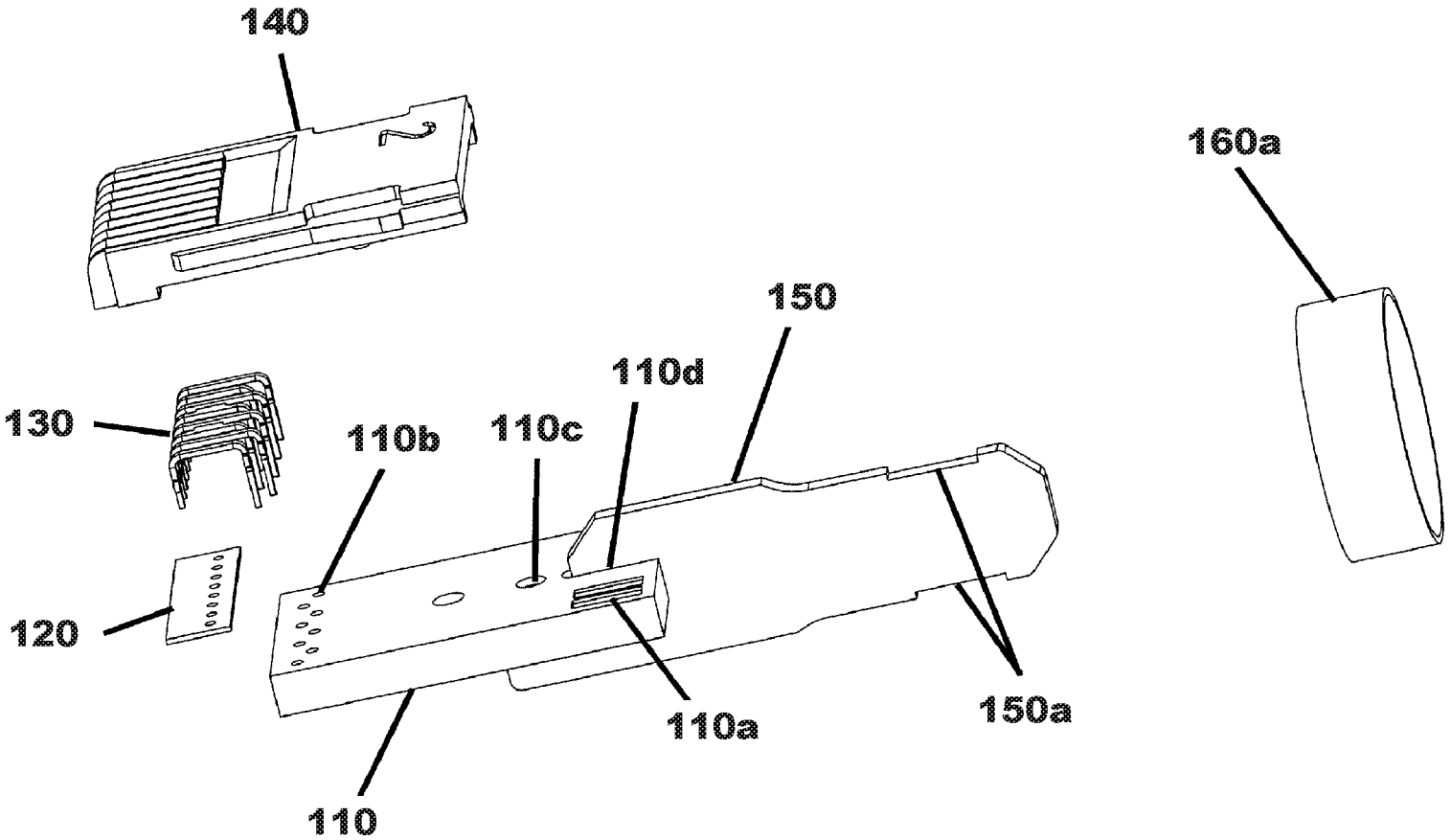
FIG. 6 is a third further exploded perspective view of the embodiment illustrated in FIG. 1.

FIGS. 5 and 6 show an exemplary embodiment of the plug sub-assembly 108. These two figures are shown in the assembled (FIG. 5) and unassembled or exploded (FIG. 6) configurations. The crimp ferrule 160 is shown in an uncrimped state 160*a* and in a crimped state 160*b*. Exemplary assembly and functionality of this plug subassembly 108 may be further detailed hereinafter.

Figure 7:
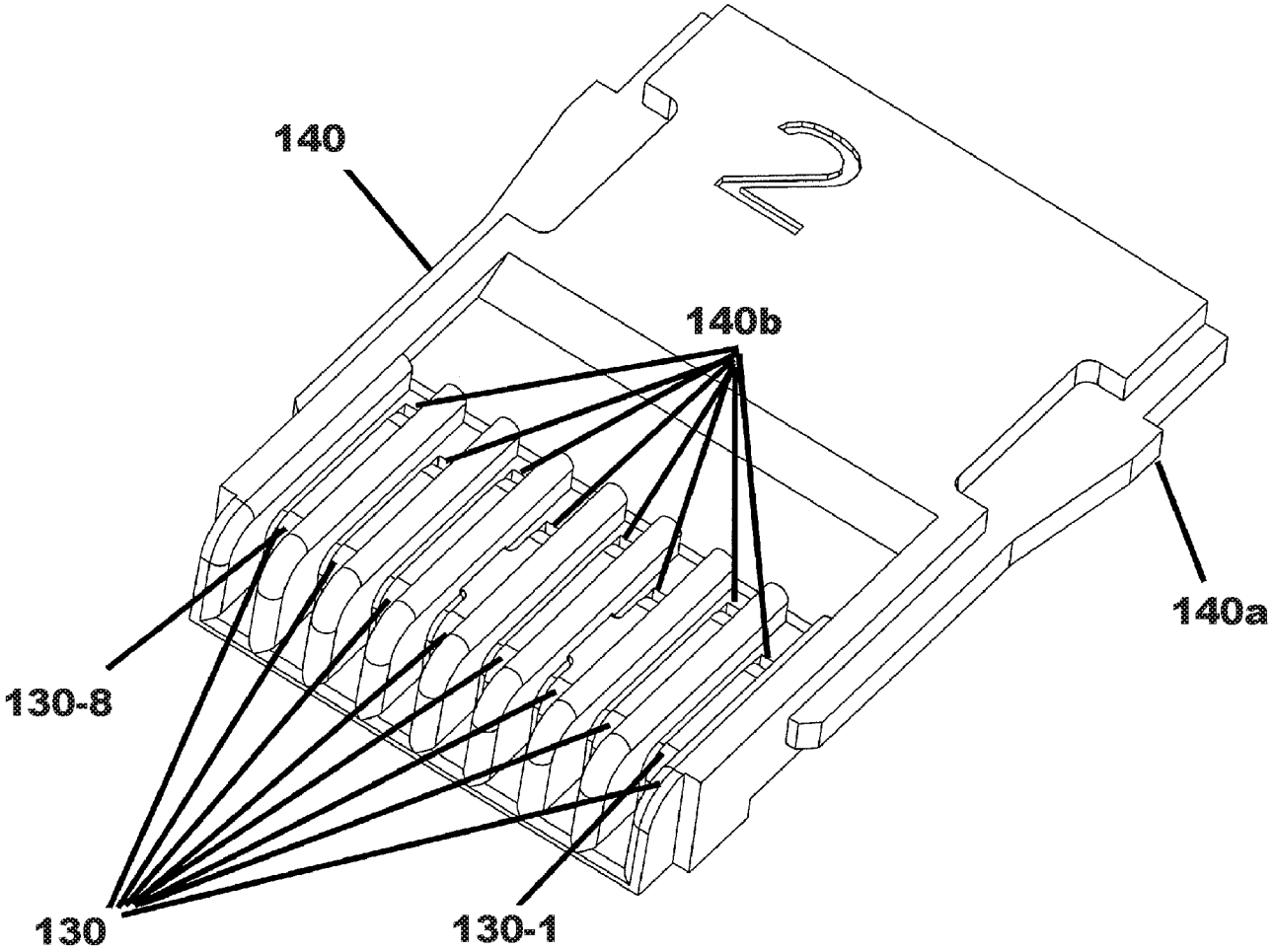
FIG. 7 is a perspective view representing an exemplary contact retainer with contacts, from the modular connector plug of FIG. 1.

FIG. 7 shows the contacts 130 inserted into a contact retainer 140 and placed onto a primary printed circuit board (PCB) 110. The contacts are held in place by the interference between slots 140*b* in the contact retainer 140 and an integral barb portion 130*a* of the contacts 130. PCB 110 is a multilayer circuit board that provides electrical signal and ground connection paths between the shielded twisted pair cable 104 and the plug signal contacts 130 and ground contacts 106*c*. The plug contacts 130 are electrically connected to PCB 110 by means of plated-through-holes 110*b*, and as further noted below, the cable pairs 170 are electrically connected to conductive pads 110*a*. The electrical paths between the plug contacts 130 and the cable pairs 170 are controlled by matched impedance conductive traces. Also controlled are the inductance and electrical length of the electrical pathways.

Figure 8:
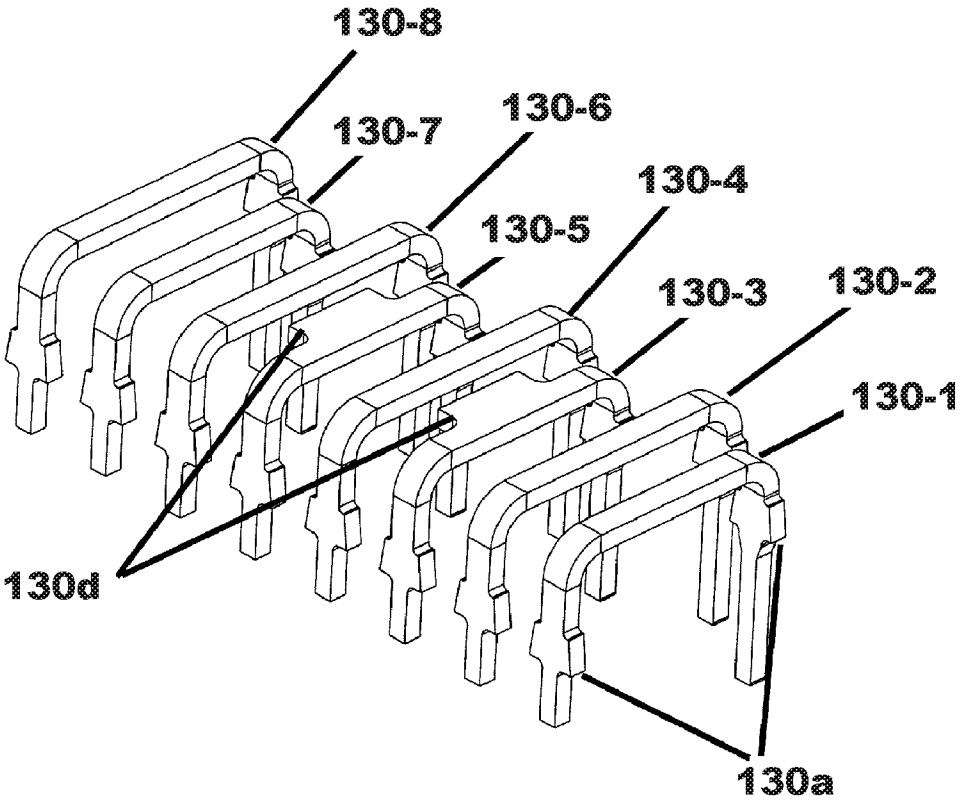
FIG. 8 is an exploded perspective view representing the contacts removed from the contact retainer of FIG. 7.

In the embodiment shown, each plug contact 130 includes a first end connected to the PCB 110 via a respective through-hole 110*b*. The first ends of each respective plug contact 130 extend in transverse orientation with respect to a length of the PCB 110. The first d of each plug contact 130 may in an embodiment also be at least coincident with a lower plane of the PCB 110. Each plug contact 130 further includes a second end which extends in parallel with the other respective second ends of the other plug contacts and in transverse orientation with respect to the length of the PCB 110. In the configuration shown, when the first end of each plug contact 130 is connected to the PCB 110 at a respective contact hole 110*b*, the second end of each plug contact overhangs the end of the PCB. Each plug contact 130 further includes what may be referred to herein as a bridge portion between the respective first end and second end. The resulting shape of each plug contact 130 may resemble a staple as shown in FIG. 8, having, for example, rounded engagement portions between the bridge and the respective ends.

The plug contact configurations are not necessarily so limited, however, and in alternative embodiments within the scope of the present disclosure it may be understood that the engagement portions may be squared, beveled, or the like.

In the embodiment shown some of the contacts, namely 130-3 and 130-5 (see contact detail in FIG. 8) are partially wider (see, e.g., 130*d*) than other contacts. All contacts are aligned linearly in the connector front facing the jack, but the odd-numbered contacts 130-1, 130-3, 130-5 and 130-7 are in general shorter the even-numbered contacts 130-2, 130-4, 130-6, 130-8. The contact through-holes 110*b* may accordingly form two rows including a row of first contact through-holes and a row of second contact through-holes, wherein the first contact through-holes are closer to the front end of the PCB 110 as facing the jack.

A high capacitive coupling is selectively created, e.g., between contact pair 130-3 and 130-4 and also contact pair 130-5 and 130-6. These contact pairs are located in the contact retainer 140 which is composed of an isolative material. The characteristic dielectric properties of this isolative material are known and controlled, thus producing a controlled capacitance between the contact pairs. Because this capacitance is intimately located at the point of contact between the plug and jack contacts, there is little to no signal delay (and phase shift) resulting in very effective capacitive compensation.

Additional capacitive compensation is provided by the secondary PCB 120 (see FIG. 3). The capacitance values developed by the secondary PCB 120 are generated by controlling the area and separation distance between parallel plates 120*b* constructed within the layers of the secondary PCB. Controlling the area, distance and dielectric constant of the insulative PCB material will control the capacitance values in the compensation zones 120*c*. Referring for illustrative purposes to FIGS. 15-17, the compensation plates 120*b* may in an exemplary embodiment be created as integral portions of the top copper layer 120*d* and the bottom copper layer 120*e*. They provide compensation for both near end cross-talk (NEXT) and return loss (RL). The value of each of said capacitors is from 100 femto-farads to 3000 femto-farads, depending for example upon the design intent.

In an embodiment, PCB 120 is located at a distal end (e.g., on the tips) of the plug contacts. The plug contacts are preferably relatively short in length, such that the compensation capacitance provided by the secondary PCB 120 is located in the immediate vicinity of the jack/plug interface. This location of the compensation capacitance is also specifically offset from or otherwise outside of the current path between the jack/plug interface and the plug cable. The connection between the compensation 120*c* and the plug contacts 130 is made by way of plated-through-holes 120*a*-1 through 120*a*-8.

Separating the primary PCB 110 from the compensation PCB 120 simplifies the manufacturability, and further enables the use of different basic materials, overall thicknesses and dielectric constants across both of the PCBs. This may further result in better control of electrical properties on both PCBs and substantially eliminate the chances of unwanted electrical interactions.

Within the primary PCB 110 are two or more horizontal ground planes 110*g* that provide electrical shielding and isolation between cable pairs 170 that are terminated to the top and bottom of the primary PCB. An additional vertical (i.e., orthogonal in orientation with respect to a surface plane of the primary PCB) shield 150 is attached to the primary PCB 110 and commoned to the ground plane(s) that reside in the primary PCB 110. This shield 150, composed of metal or other conductive substance, provides electrical shielding and isolations between cable pairs 170 that are terminated to the right and left sides of the primary PCB. This electrical shielding acts to mitigate exchange of high frequency electrical signals between cable pairs 170. Shield 150 is located by a plated-through-hole 110*e* and within an air-gap slot 110*d*. The air-gap 110*d* is arranged along a longitudinal axis of the primary PCB and in parallel with the adjacent conductor traces. This is done to avoid any inductive resonance coupling between the paths of the signal pairs.

Referring to an exemplary embodiment as shown in FIGS. 11-14, the conductive paths between the cable solder pads 110*a* and the contact plated through holes 110*b*-1 through 110*b*-8 are shown s signal traces 110*t*. These are portions of both the top copper layer 110*h* and bottom copper layer 110*k*. For each signal pair, the traces 110*t* are located over a ground plane 110*g* in parallel orientation to generate controlled impedance zones 110*i*. The control is maintained by prescribing the width of the traces 110*t*, the spacing between the traces 110*t* and ground planes 110*g*.

Figure 9:
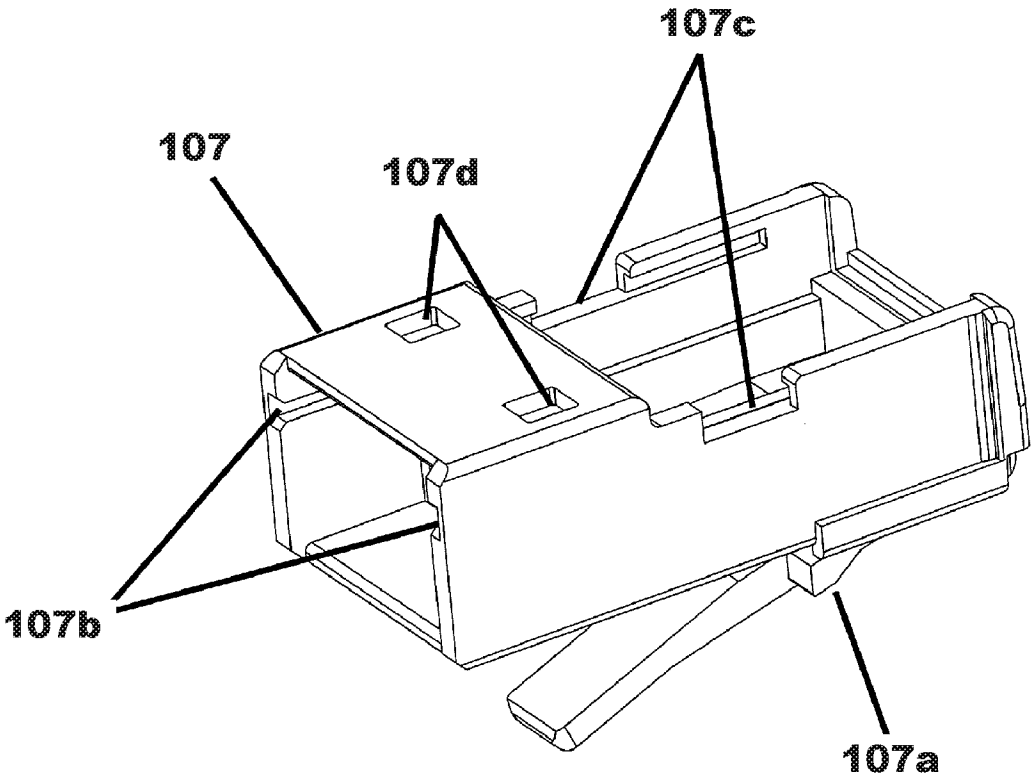
FIG. 9 is a perspective view representing a front plug housing for the modular connector plug of FIG. 1.

An exemplary embodiment of the front plug housing 107 is shown in FIG. 9. The plug latch 107*a* engages with the latching feature in standard jacks to provide easily accessible and positive connector engagement and retention. At the rear of the plug housing 107 are the entrances of the plug subassembly guide slots 107*b*. The terminated plug subassembly 108 is inserted into these slots. The slots locate and retain the subassembly 108 to ensure proper electrical and mechanical performance. When the subassembly 108 is fully inserted, the contact retainer latches 140*a* engage with the notches 107*c* in the sides of the front housing 107. This ensures retention and location of the subassembly 108. Additionally, these notches 107*c* engage with the shield tabs 106*a* when these are formed over. This further ensures that the fully assembled plug will have no chance of becoming disassembled during normal usage. Latching holes 107*d* are also provided to retain the main shield 106 and the front housing 107 during the manufacturing process and after final assembly.

Figure 10:
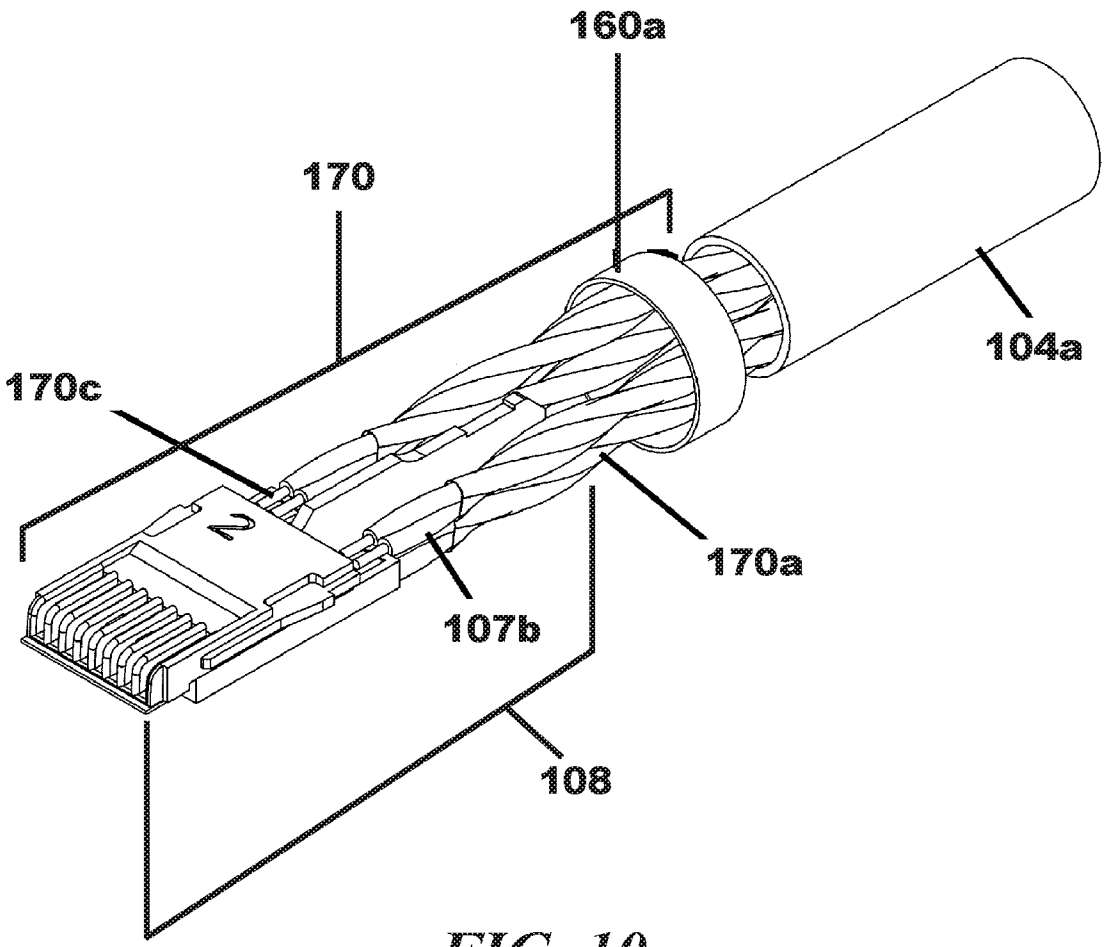
FIG. 10 is a perspective view representing a plug subassembly for the modular connector plug of FIG. 1, terminated to a shielded twisted pair cable as disclosed herein.
Figure 11:
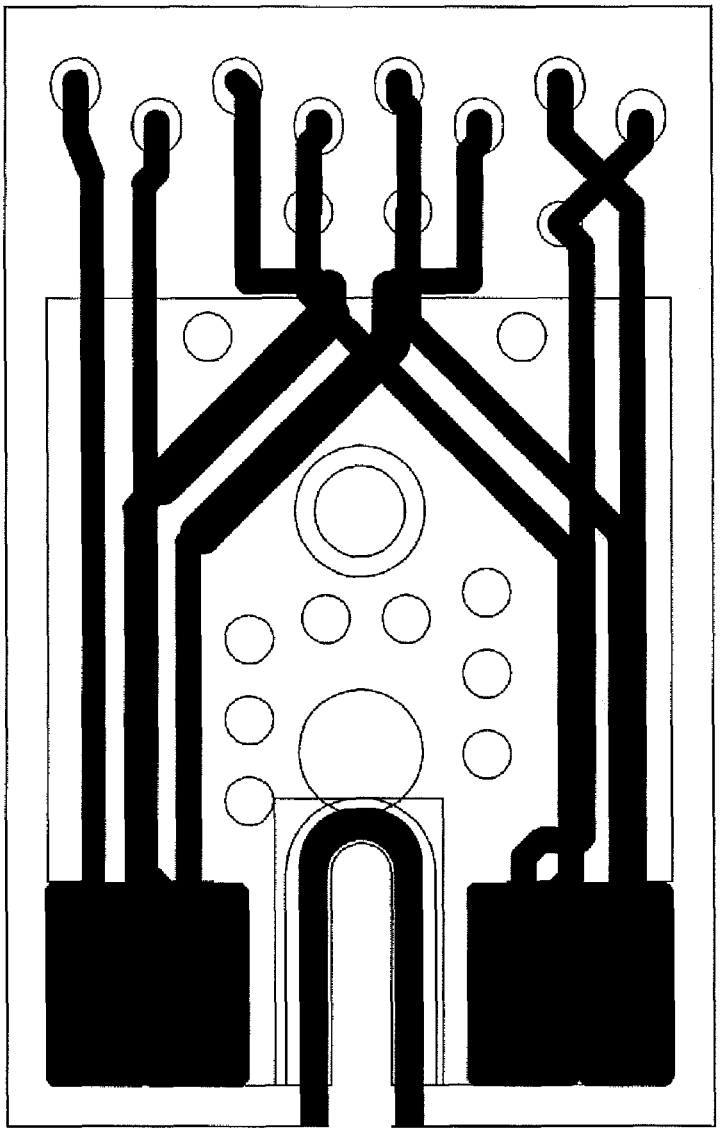
FIG. 11 is a top view representing an exemplary primary printed circuit board (PCB) for the embodiment of a modular plug as illustrated in FIG. 1.
Figure 12:
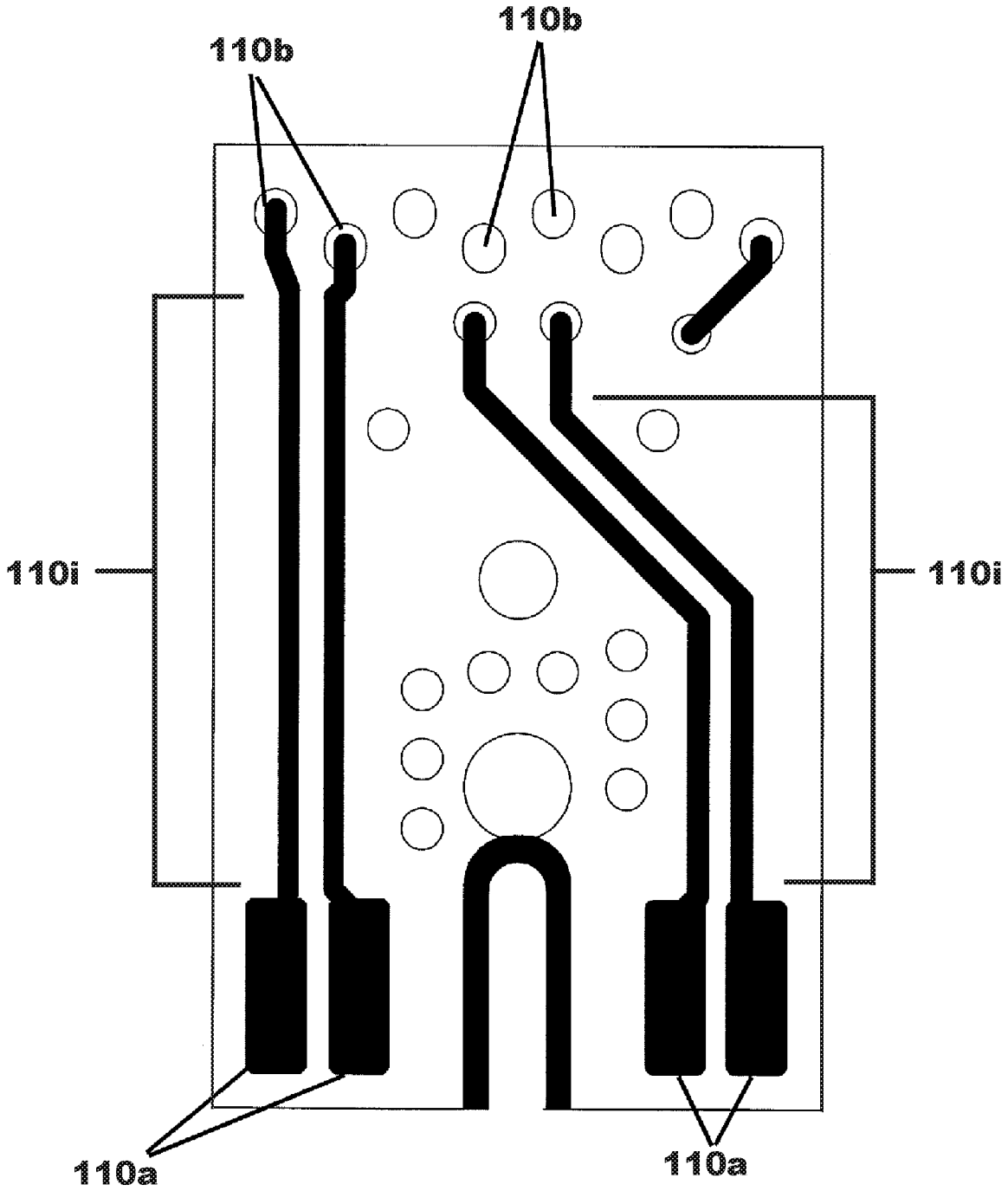
FIG. 12 is a top view representing exemplary top copper layer for the primary PCB of FIG. 11.
Figure 13:
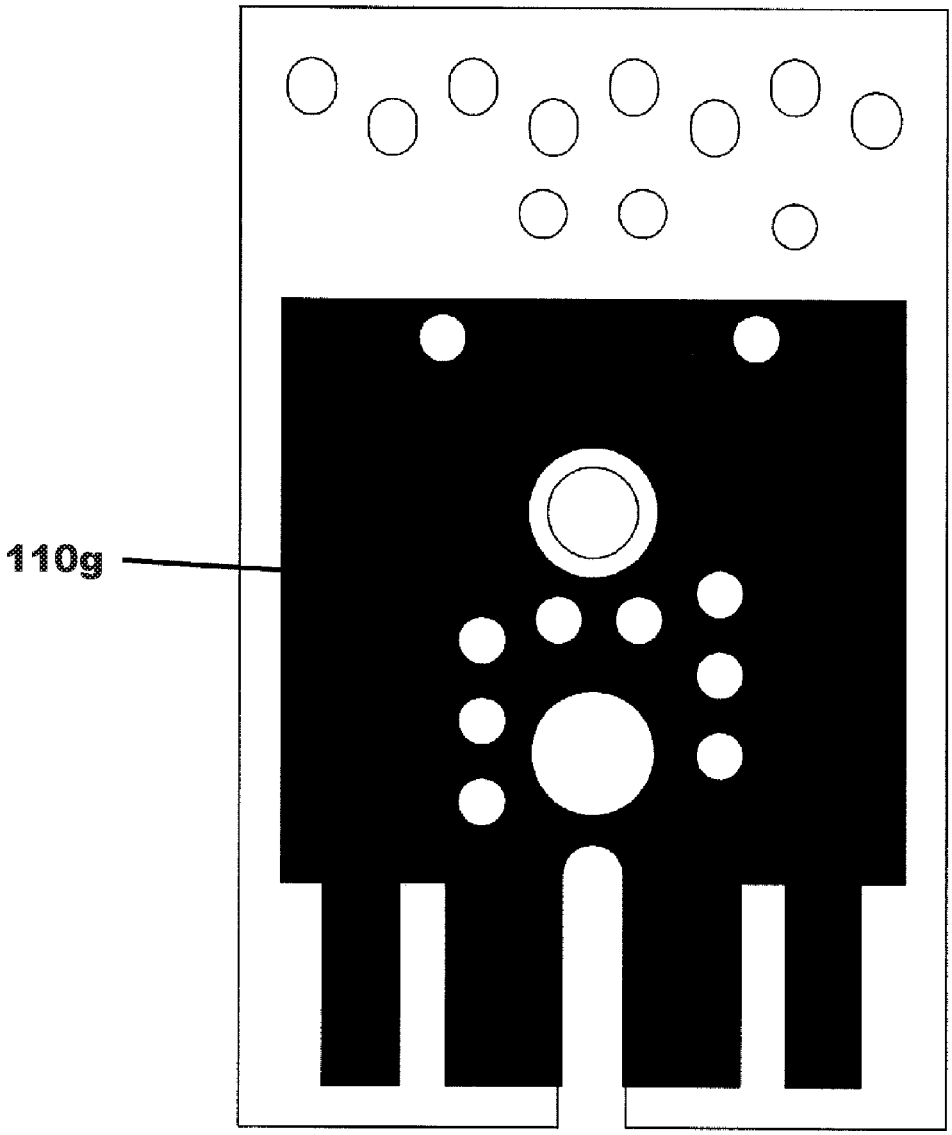
FIG. 13 is a top view representing an exemplary ground plane for the primary PCB of FIG. 11.
Figure 14:
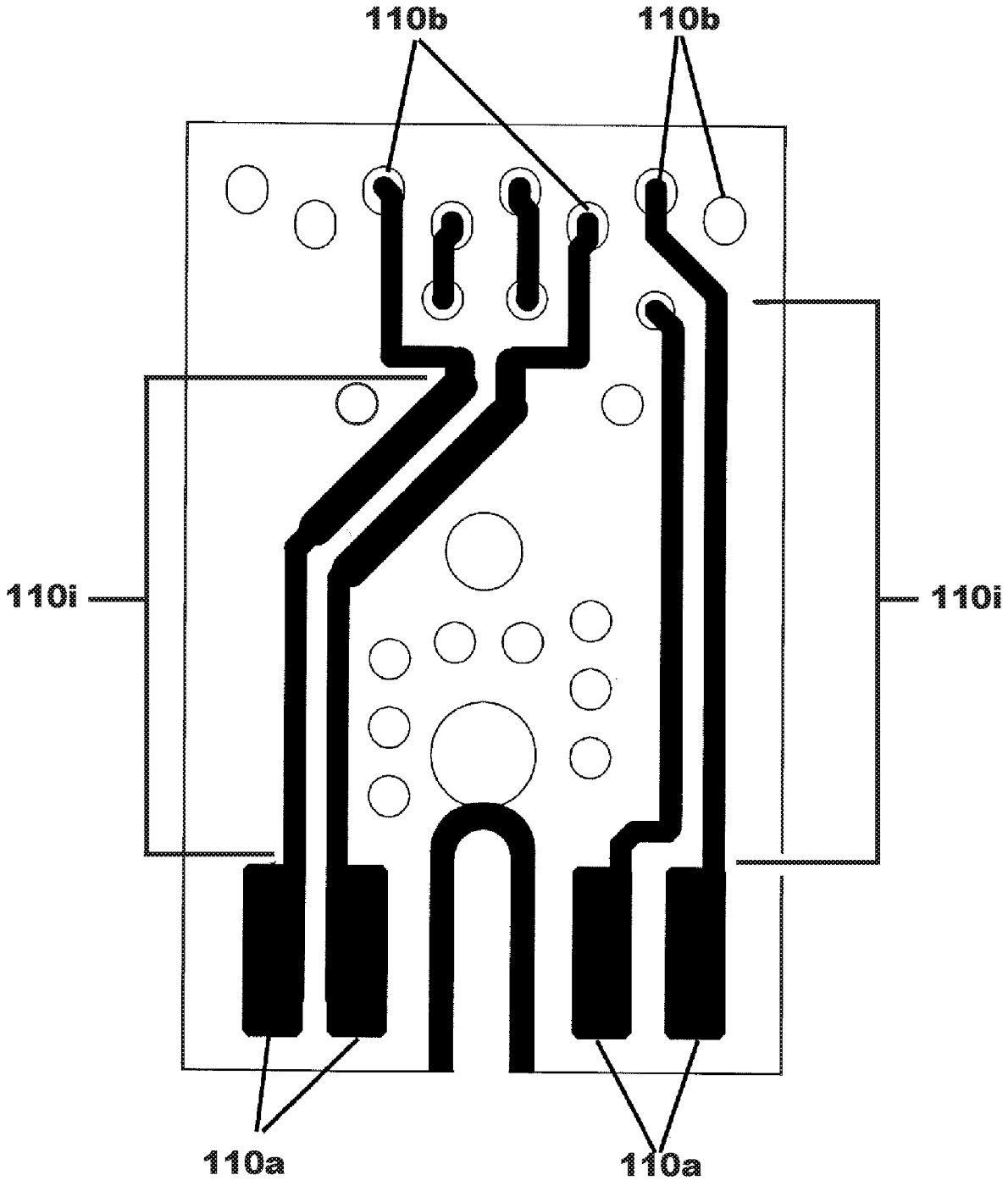
FIG. 14 is a top view representing an exemplary bottom copper layer for the primary PCB of FIG. 11.
Figure 15:
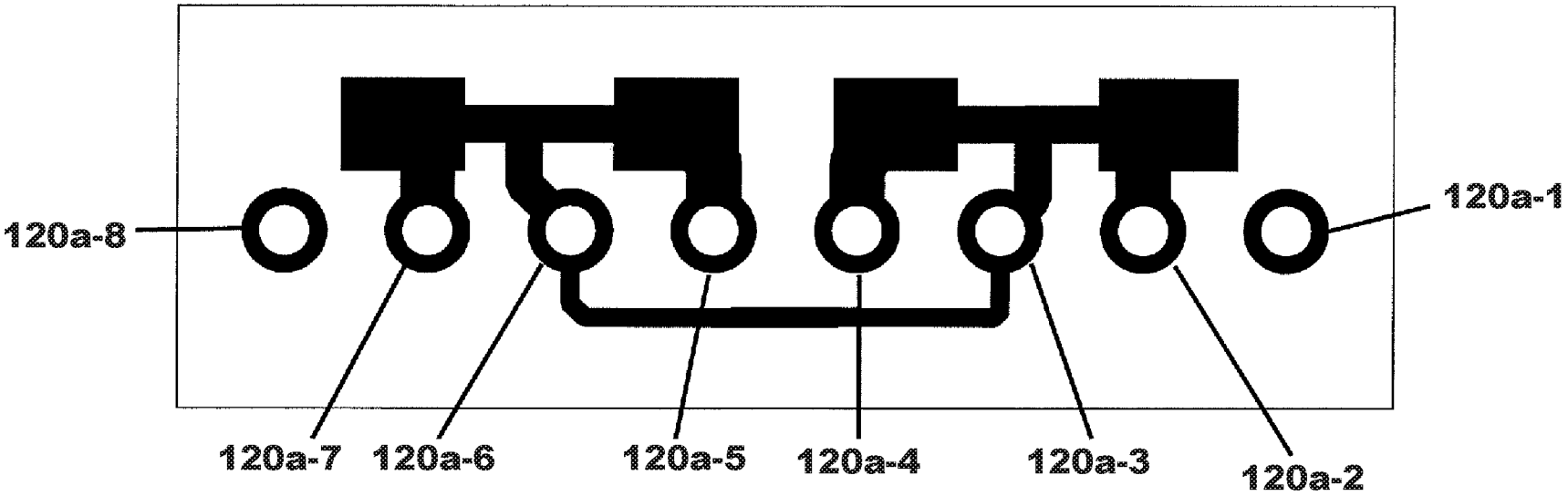
FIG. 15 is a top view representing an exemplary compensation PCB for the embodiment of a modular plug as illustrated in FIG. 1.
Figure 16:
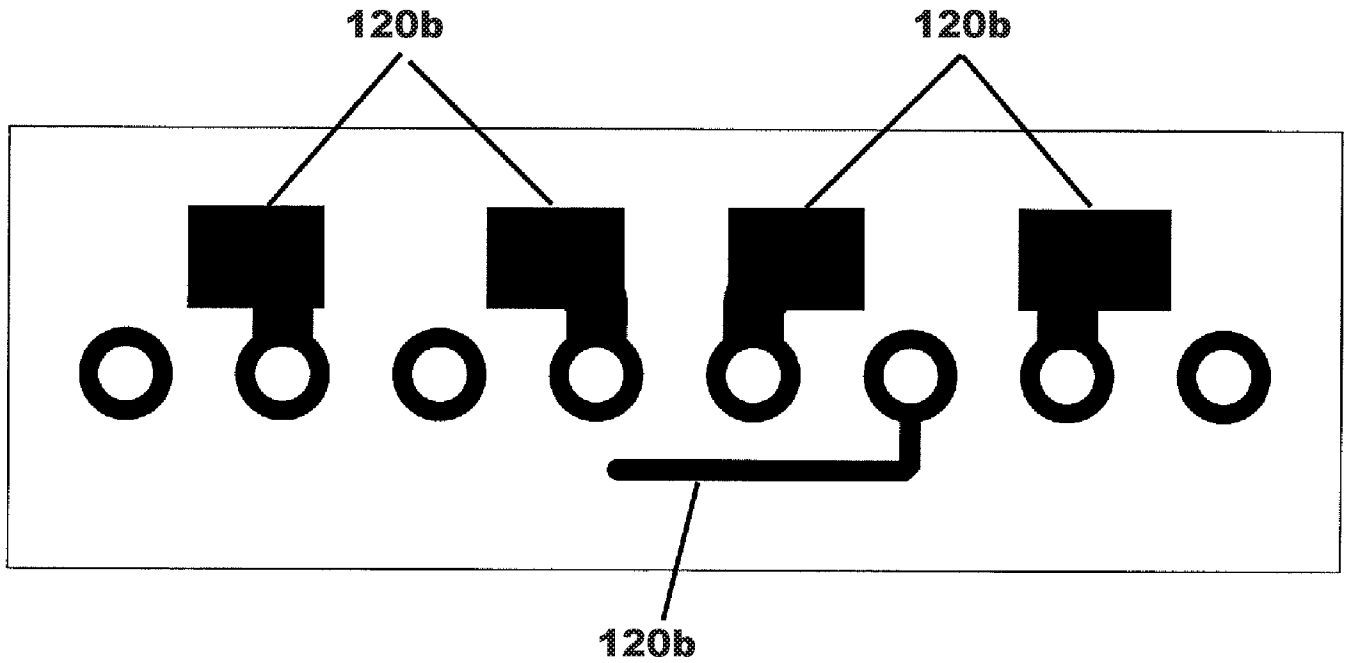
FIG. 16 is a top view representing an exemplary top copper layer for the compensation PCB of FIG. 15, including NEXT and RL compensation capacitance plates.
Figure 17:
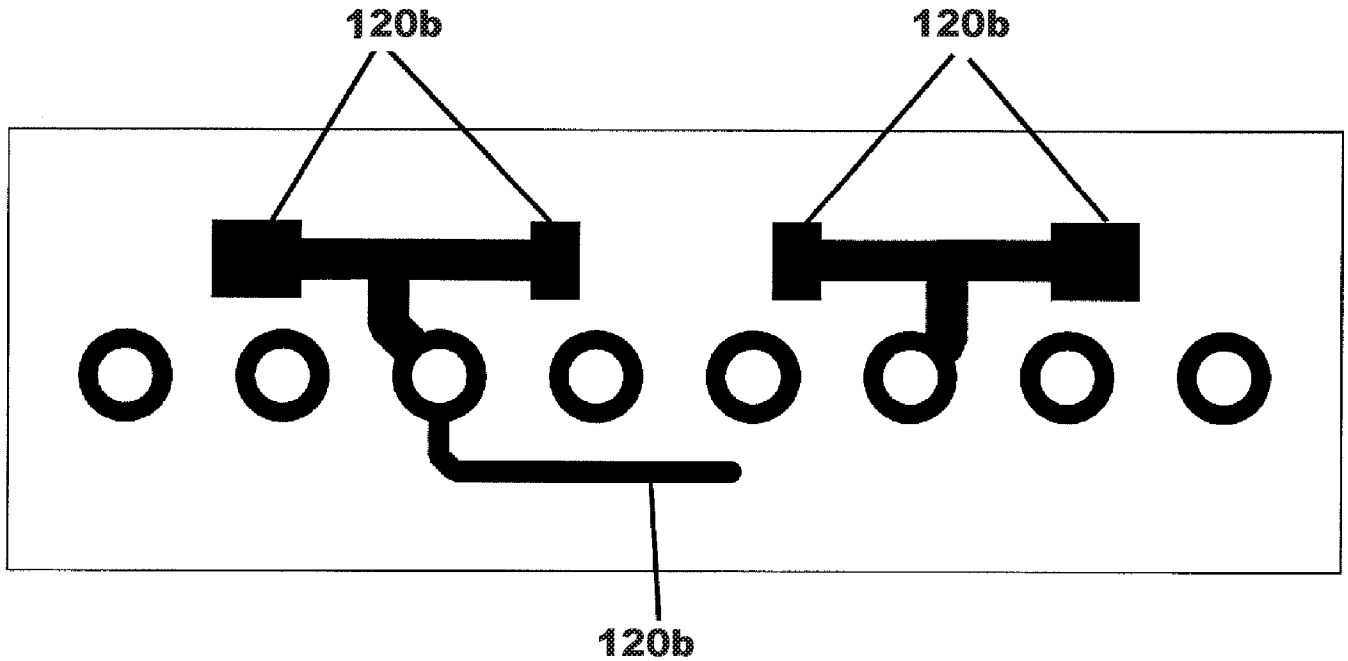
FIG. 17 is a top view representing exemplary bottom copper layer for the compensation PCB of FIG. 15, including NEXT and RL compensation capacitance plates.

FIG. 10 shows the plug subassembly 108 terminated to the shielded twisted pair cable 104. Prior to termination, the strain relief and main shield are threaded over the end of the cable. Then the crimp ferrule 160*a* is also threaded over the end of the cable. These are then pushed up the cable and out of the way du ring cable preparation.

An exemplary preparation sequence for the cable 104 may now be described. The cable jacket 104*a* is initially removed from the end of the cable 104, and the four twisted pairs 170 are separated. The shielding foil 170*a* is cut back from the ends of the pairs 170, and a short section of the wire insulation 170*b* is cut off, exposing the signal conductors 170*c*.

After the cable 104 is prepared, the conductors 170*c* are arranged in the proper wiring pattern. The conductors 170*c* are terminated to the conductive pads 110*a* on PCB 110. For termination, the conductors are attached by means of welding, soldering or similar process. After the cable pairs are terminated to the primary PCB 110, the crimp ferrule 160*a* is pushed toward the plug subassembly 108. The crimp ferrule 160*a* is aligned pith the notch 150*a* in the vertical shield 150, and then crimped with an appropriate termination tool. Crimping of the crimp ferrule now 160*b*, acts to common the shielding of the twisted pairs 170*a* and the vertical shield of the plug subassembly 108 and thus to the ground plane(s) of the primary PCB 110.

The terminated plug assembly 108 is then inserted into the slots 107*b* in the front housing 107. The subassembly is pushed forward until the latches 140*a* fully engage with the front housing notches 107*c*. The strain relief 105 and main shield 106 are then pushed up over the front housing 107 and latched in place. The plug is now fully assembled and ready for testing and use.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the follow claims.

What is claimed is:

1. A modular connector plug apparatus for forming a connector interface with a connector jack in a high speed data transmission network, comprising a housing and a contact subassembly configured for positioning within the interior of said housing and further comprising a first printed circuit hoard (PCB) having a first end and a second end, the second end comprising conductive mounting pads for each of a plurality of cable pairs, the apparatus further characterized in that:

the housing comprises an insulative front portion and a conductive shield portion attachable to define the interior, and the contact subassembly comprises a plurality of elongate plug contacts each comprising a first end mounted on the first end of the first PCB, a second end distal from the first end, and a bridge portion there between, the bridge portions of the plurality of plug contacts collectively defining an interface for corresponding contacts of a connector jack, and the respective second ends of the plurality of plug contacts mounted on a second PCB, wherein the second PCB comprises desired electrical characteristics which provide the apparatus with certain capacitance compensation properties, and wherein the capacitance compensation is offset from a signal path defined between the jack-plug connector interface and the cable pairs.

2. The apparatus of claim 1, wherein the first PCB further comprises:

through holes for receiving the respective first ends of the plug contacts; and an air gap slotted from the second end and extending ire parallel with electrical traces between the through-holes and the mounting pads.

3. The apparatus of claim 2, comprising a substantially planar conductive shield located within the slotted air gap and commoned to one or more ground planes within the first PCB, in an orthogonal orientation with respect to a surface plane of the first PCB.

4. The apparatus of claim 3, wherein first and second pairs of conductive mounting pads are provided on a first surface of the first PCB, and respectively positioned on opposing first and second sides of the planar conductive shield, and third and fourth pairs of conductive mounting pads are provided on an opposing second surface of the first PCB, and respectively positioned on the opposing first and second sides of the planar conductive shield.

5. The apparatus of claim 4, wherein the bridge portion for each plug contact has a maximum width extending in a direction perpendicular to a PCB length, at least one plug contact having a maximum width greater than the maximum width of another plug contact, wherein each plug contact defines an electrode of a further compensating capacitance formed between adjacent pairs of plug contacts, each further compensating capacitance defined at, least partially by a distance between the respective adjacent pair of plug contacts at the contact interface.

6. The apparatus of claim 5, wherein the respective bridge portion for each plug contact has a length extending between the first end and the second end, at least one plug contact having a bridge portion length shorter than the bridge portion length of another plug contact.

7. The apparatus of claim 6, wherein the respective first ends for a first plurality of plug contacts and a second plurality of plug contacts are situated in first and second parallel spaced planes.

8. The apparatus of claim 1, wherein the contact subassembly comprises a contact retainer configured to receive the plurality of contacts and composed of an isolative material having characteristic dielectric properties providing a supplemental capacitance compensation between adjacent contact pairs and offset from the signal path.

9. The apparatus of claim 8, wherein the contact retainer comprises first and second opposing side portions with protrusions extending therefrom, and wherein the front portion of the housing comprises corresponding first and second interior slots configured to slidably receive the first and second opposing side portions via the protrusions.

10. The apparatus of claim 9, wherein the first and second interior slots comprise notches along their respective lengths, and the protrusions are configured to compress during insertion into the front portion of the housing and then extend outward to engage the notches.

11. The apparatus of claim 10, wherein the front portion of the housing comprises a top side having one or more apertures, and the conductive shield portion of the housing comprises a respective one or more latches configured to engage the one or more apertures when the front portion and the conductive shield portion are slidably engaged.

12. The apparatus of claim 11, wherein the conductive shield portion comprises jack grounding tabs extending along first and second opposing outer side walls of the front portion of the housing when the front portion and the conductive shield portion are slidably engaged.

13. The apparatus of claim 12, wherein the first and second jack grounding tabs further respectively comprise shield retention tabs configured to fold over the notches of the first and second interior slots when the front portion and the conductive shield portion are slidably engaged, further to engage the protrusions of the contact retainer as extended outward and retained therein.

14. The apparatus of claim 13, wherein the bridge portion for each plug contact has a maximum width extending in a direction perpendicular to a PCB length, at least one plug contact having a maximum width greater than the maximum of another plug contact, wherein each plug contact defines an electrode of a further compensating capacitance formed between adjacent pairs of plug contacts, each further compensating capacitance defined at least partially by a distance between the respective adjacent pair of plug contacts at the contact interface.

15. The apparatus of claim 14, wherein the respective bridge portion for each plug contact has a length extending between the first end and the second end, at least, one plug contact having a bridge portion length shorter than the bridge portion length of another plug contact.

16. The apparatus of claim 15, wherein the respective first ends for a first plurality of plug contacts and a second plurality of plug contacts are situated in first and second parallel spaced planes.

17. The apparatus of claim 1, wherein the second PCB comprises a plurality of substrate layers having parallel plates disposed therein, and a value of the capacitance compensation is defined by an area, distance and dielectric constant associated therewith.

18. The apparatus of claim 1, wherein the contact subassembly is configured to withstand 1000 VDC between any two adjacent contacts, and 1500 VDC between any two non-adjacent contacts and/or between any one contact and the conductive shield, without shorting or flash-over.

* * * * *